United States Patent [19]

Bender et al.

[11] 4,028,192

[45] June 7, 1977

[54] APPARATUS FOR RECEIVING INCANDESCENT COKE FROM RESPECTIVE COKE OVENS IN A BATTERY AND FOR REMOVING THE COKE IN A CLOSED CHAMBER AWAY FROM THE BATTERY

[75] Inventors: Martin Bender, Dusseldorf; Johannes Knappstein; Josef Stratmann, both of Recklinghausen, all of Germany

[73] Assignees: Firma Carl Still; Hartung, Kuhn & Co. Maschinen fabrik GmbH, both of Germany

[22] Filed: Nov. 26, 1975

[21] Appl. No.: 635,285

[30] Foreign Application Priority Data

Nov. 26, 1974 Germany ..... 2455830

[52] U.S. Cl. ..... 202/227; 202/230; 202/262; 202/263; 202/253; 214/18 PH; 105/366 E; 105/366 R; 105/247; 214/35 R; 214/18 SC

[51] Int. Cl.[2] ..... C10B 39/00

[58] Field of Search ..... 202/227, 230, 262, 263, 202/253; 214/18 R, 18 PH, 18 SC; 105/247, 248, 249, 366 E, 366 R

[56] References Cited

UNITED STATES PATENTS

| | | | |
|---|---|---|---|
| 3,748,235 | 7/1973 | Pries | 202/227 |
| 3,772,155 | 11/1973 | Knappstein et al. | 202/263 |
| 3,844,900 | 10/1974 | Schulte | 202/227 |

*Primary Examiner*—James H. Tayman, Jr.
*Attorney, Agent, or Firm*—McGlew and Tuttle

[57] ABSTRACT

An apparatus for receiving incandescent coke from respective coke ovens of a horizontally arranged battery of coke ovens, comprises a wheeled carriage which is adapted to move backwardly and forwardly along the battery of coke ovens. A coke cake receiving device is mounted on said carriage and includes a hood portion which is adapted to be aligned with each of the coke ovens upon movement of the carriage to the particular coke oven to be discharged and which also includes means for separating contaminants from the gases which are generated from the coke and for discharging purified gases. The coke hood portion has an openable and closable lateral door for receiving the irridescent coke from the associated oven and for closing the hood thereafter. The coke entering the hood is received by a tank arranged below the hood. The tank may be formed so as to provide a closed or sealed connection with the hood portion and it includes engagement means thereon which permits either the tank alone or the tank with the hood portion to be lifted away from the carriage for transport to a separate location for discharge of the coke. When the coke receiving tank is disassociated from the hood, it is engaged with a cover so that it will keep the coke therewithin and prevent gases escaping therefrom during its movement.

9 Claims, 3 Drawing Figures

FIG. 1
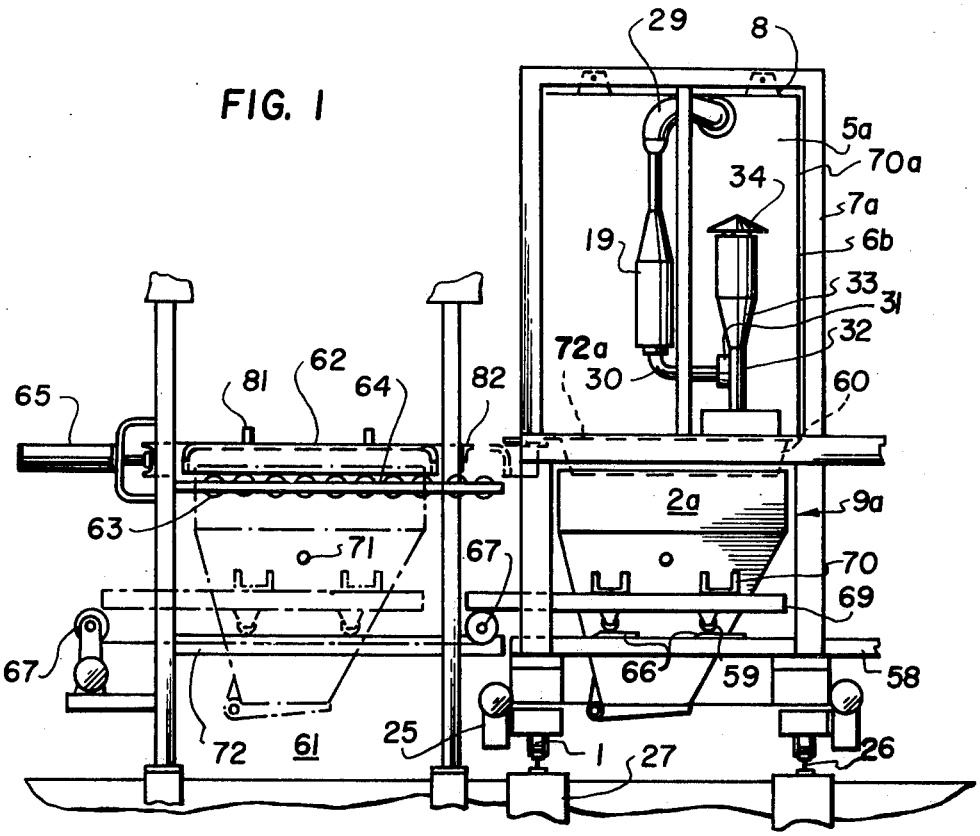
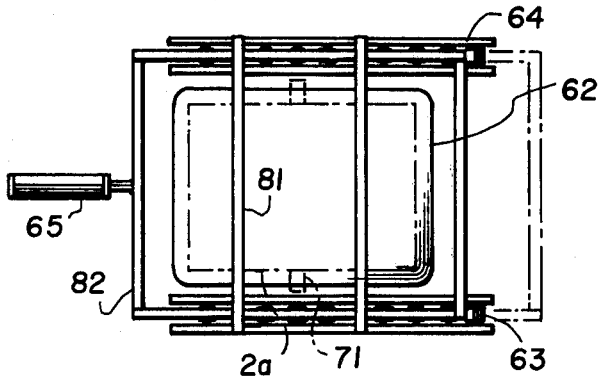
FIG. 2

APPARATUS FOR RECEIVING INCANDESCENT COKE FROM RESPECTIVE COKE OVENS IN A BATTERY AND FOR REMOVING THE COKE IN A CLOSED CHAMBER AWAY FROM THE BATTERY

FIELD AND BACKGROUND OF THE INVENTION

This invention relates in general to the construction of devices for operating coke ovens and, in particular, to a new and useful device for receiving the incandescent coke from each oven and for transporting it into a tank which may be maintained in a closed position after it is disassociated from a carriage which moves backwardly and forwardly along a coke oven battery.

REFERENCE TO PRIOR PATENT APPLICATION

This invention is an improvement over the device disclosed in U.S. pat. application Ser. No. 495,204, filed on Aug. 6, 1974 for "CLOSED TANK COKE CAR CONSTRUCTION", now pending.

DESCRIPTION OF THE PRIOR ART

The present invention is an improvement over the invention disclosed in U.S. pat. application Ser. No. 495,204, particularly in the provision of a hood and tank receptacle construction for transporting the incandescent coke away from the coke oven batteries without opening the coke to the atmosphere so that the atmosphere might be subject to contamination from the emissions from the coke. It is already known to provide a receiving tank for receiving coke which is discharged and arranged in an arrangement wherein the transfer from a carriage to a fixed location is effected substantially without any exposure of the coke to the atmosphere. For this purpose, the tank includes walls which are madeup of plates which are loosely abutting and heat-resistant and which are suspended from layers and overlap one another on all sides. The hood covering of the tank is designed as a heat-resistant steel skeleton to which heat-resistant metal plates are clamped in layers and so as to overlap one another. The steel skeleton is suspended from the steel structure which is supported on the undercarriage which moves backwardly and forwardly along the battery of coke ovens. Such a construction is disclosed in applicant's prior application Ser. No. 495,204, U.S. Pat. No. 3,970,526 issued July 20, 1976 and it has proved very satisfactory in practice. It is usable under various conditions and its use is not limited to certain quenching medium for the incandescent coke. It can be used for both wet quenching and for dry quenching.

In another particular arrangement, the coke tank is provided with a closable coke discharge opening which is located laterally below, and with a bottom which is sloping down to the coke discharge opening. This design is advantageous, for example, in cases where the coke is delivered to the quenching plants which are flush with the ground.

There is a need, however, at the present time, to adapt a tank car in a still further manner to the local conditions in the coking plants. What particularly matters, is the number of chamber ovens to be served by the tank car, as well as the type and arrangement of the quenching plant. Such adaptations can lead to savings in materials and personnel.

SUMMARY OF THE INVENTION

In accordance with the present invention, there is provided a construction which includes a coke receiving device having a hood portion and a tank portion which are carried by an undercarriage which is movable backwardly and forwardly along the coke oven. In accordance with a feature of the invention, either the tank portion alone or the hood portion and tank portion together are movable away from the carriage for the discharge of the coke at a remote station. With such a construction, two or more coke tanks, with or without an associated hood can be transported on a single undercarriage. In a large coke plant having numerous coke oven chambers, the coke tanks placed on the undercarriage are filled while the carriage is at rest with red-hot coke and then transported to the quenching or transfer station. There they are lifted from the undercarriage and transferred to the station. A previously emptied coke tank is transferred back to the undercarriage. Then, the tank car is complete again and ready for receiving the next charge of incandescent coke.

Since, in this latter case, during the discharge time, the coke tank is no longer connected to the undercarriage, it is ready for receiving further coke charges from the ovens immediately after the lifting of the full tank and the replacement of an empty tank. The frequency of operation and the number of its travels is thus increased instead of requiring a plurality of separate tank cars and only one undercarriage with a plurality of tanks may be employed instead.

The design is particularly simplified if the hood is fixed on the undercarriage and the coke tank alone is made separable from the undercarriage and from the hood. Such a design is useful in all cases where the quenching plant is designed so that the coke tank is directly received in a closed space and this space is directly connectable to the covering for the tank car.

With the invention, the coke tank is provided with engagement means in the form of lateral bars on which it can be engaged or supported and lifted from the undercarriage and moved in a travel direction, or transversely thereto, by means of a conveyor, such as a roller train. The coke tank itself may also be provided with lateral rollers which rest on steel supports. In such a case, it suffices to connect the steel supports of the quenching plant with those of the undercarriage for the removal of the coke tank.

In another design of quenching plant the tank car is designed so that the coke tank is separable from the undercarriage along with its covering hood and, for this purpose, the steel structure of the hood is provided with engagement means, such as a carrying eye, into which a crane hook may be engaged. Then the tank is transferred along with its associated hood to the coke-receiving location of the quenching plant. This does not require a separate transfer space which communicates with the hood.

In another embodiment, it is provided with the coke tank along with the hood is lifted by pivotal arms which engage on lateral lugs and the assembly is transferred away from the undercarriage.

For very large plants, an undercarriage may be provided on which a plurality and preferably two coke tanks can be placed and transported. In such a case, the undercarriage is equipped with a number of hoods corresponding to the number of coke tanks or an undercarriage for a plurality of coke tanks may be provided which has a fixed single covering hood which serves a plurality of tanks.

In the construction wherein the hood is separable along with the coke tank, the energy for the exhaust blowers of the hood may be supplied through conventional trailing cables and plug devices so that, in case of need, the taking off and the cleaning of the dust-containing gases emanating from the coke can be continued even after the coke tank, along with the hood, has been separated from the undercarriage.

Accordingly, it is an object of the invention to provide an apparatus for receiving incandescent coke from respective coke ovens of a horizontally arranged battery of coke ovens and which comprises a wheeled carriage adapted to move backwardly and forwardly along the coke oven and a coke-receiving device on the carriage which includes a hood portion adapted to be aligned with each of the respective ovens upon movement of the undercarriage and which includes gas purifying means associated therewith and a coke tank portion located below for receiving the discharged coke and with transport means associated with the carriage engageable with the engagement means which may be on either the tank or the hood portion, or both, in order to transport at least the tank portion away from the undercarriage.

A further object of the invention is to provide a device for receiving glowing coke from coke oven batteries and for subsequently transferring the coke into a tank and for delivering the glowing coke without exposure to the atmosphere to a quenching station which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

BRIEF DESCRIPTION OF THE DRAWINGS

In the Drawings:

FIG. 1 is a side elevational view of an apparatus for receiving glowing coke from coke oven batteries, constructed in accordance with the invention;

FIG. 2 is a partial top plan view of the transport means; and

DESCRIPTION OF THE PREFERRED EMBODIMENTS

Figure 3:
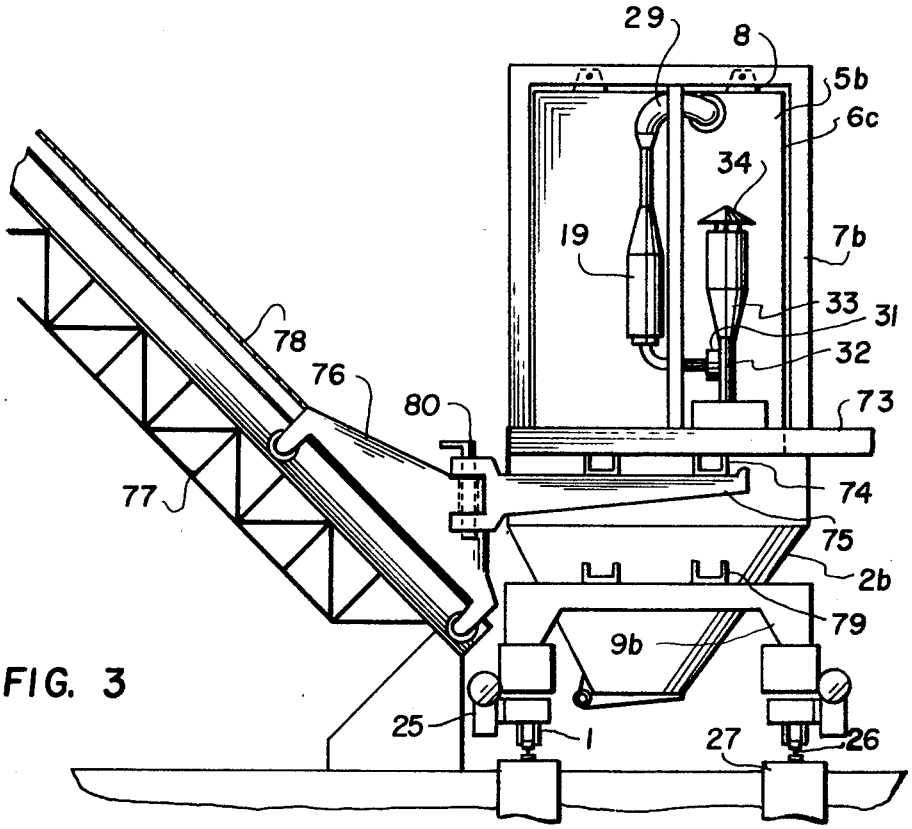
FIG. 3 is a view similar to FIG. 1 of another embodiment of the invention.

Referring to the drawings in particular, the invention embodied in FIGS. 1 and 2, comprises an apparatus for receiving incandescent coke from individual coke ovens of a horizontally arranged battery of coke ovens (not shown) which includes an undercarriage 9*a* having wheels 1 which are movable backwardly and forwardly on a track or rail 26 over a ground support 27 and in respect to a whole battery of coke ovens which are arranged in a horizontal row along the ground foundation. The undercarriage 9*a* includes carrier beams 58 having cam surfaces or lifting surfaces 66 thereon for receiving a wheeled beam 69 having wheels 59 which engage over the lifting surfaces in the position indicated in FIG. 1. Carrier beams 58 form a support for a coke tank 2*a* which in turn is supported by lugs 70 on beams 69 having the wheels 59.

In accordance with the invention, the apparatus includes a hood portion which includes an outer steel structure 7*a* and an inner steel skeleton 6*b* around a hood portion 5*a*. The hood 5*a* is suspended by means of eyes or clamping brackets and bolts 8 from frame 7*a*. Hood portion 5*a* includes a lateral opening on a wall 70*a* which may be opened to receive glowing coke from a coke oven and then closed with the coke therein against atmosphere. In addition, hood portion 5*a* includes a bottom 72*a* with an openable and closable device for dumping the coke which is received in the hood portion directly downwardly into a coke-receiving tank 2*a*. The lower end of hood 5*a* is provided with a retracted conical collar 60 which applies against the walls of the coke tank 2*a* so that the whole unit is sealed together and there will be no emissions to the atmosphere.

In order to discharge the incandescent coke, the undercarriage 9*a* is moved into alignment with a transfer station 61 which may be located in alignment with the coke oven batteries or off to one side thereof. The transfer station in the embodiment of FIGS. 1 and 2 includes a tank cover 62 which rests by means of beams 81 on a frame 82. The frame 82 along with cover 62 are moved by means of a hydraulic motor 65 and on rollers 63 along beams 64 up to the tank car 2*a*. A drive 67 moves the coke tank 2*a* in the direction of the transfer station 61. During this motion, the wheels 59 leave the lifting surfaces 66 and the coke tank 2*a* is lowered down to the top of the surface of the beam 58 which is sufficient to cause the collar 60 to become positioned above the top of the tank and no longer project downwardly therein. This frees the coke tank 2*a* so that drive 67 may pull it into the transfer station 61. During this motion, cover 62 is shifted over coke tank 2*a* and moves back with the tank into the transfer station so that no uncovering of the glowing coke to the atmosphere takes place. During the displacement of the coke tank, cover 62 covers the tank by the amounts at which the tank projects from below hood 5*a*. In this manner, the tank will be effectively covered at all times. Tank 2*a* includes engagement wings which may include carrying eyes 71 into which a crane hook can be engaged along with the cover 62 to the quenching station, not shown. Undercarriage 9*a* is then in a condition ready to receive an empty coke tank 2*a* and after it does, the movement of the empty coke tank back into association with the undercarriage 9*a* is effected.

The waiting time of the undercarriage 9*a* at the transfer station 61 is reduced to the time necessary for shifting the full coke tank into the transfer station and for lifting it outwardly therefrom. In immediate succession, an empty coke tank can be lowered onto support beam 72 of transfer station 61 and then received by the undercarriage 9*a*. It is not necessary too wait for the discharge of the coke from the coke tank, so that the undercarriage 9*a* is immediately ready with an empty tank to receive a further charge of coke from the battery. This is particularly advantageous during disturbances in the transfer of incandescent coke from coke tanks into the quenching station.

The undercarriage 9*a* is driven by a drive 25 to move it along the rails 26. The coke receiving device hood portion advantageously includes a conduit 29 for passing the gases from the coke through conduits 19 and 30 to an exchanger 31 where the solids are removed and collected in a separator 32 and the flue gases are permitted to move upwardly through a flue 33 beneath a top cover 34.

In the embodiment indicated in FIG. 3, similar parts are similarly designated. In this embodiment, the apparatus for receiving incandescent coke from the respective coke ovens includes a hood portion 5*b* which remains associated with a tank portion 2*b* which are together supported on an undercarriage 9*b*. In this embodiment, a beam 73 supports steel structure 7*b* for the steel skeleton 6*c* of the hood 5*b*. The engagement means includes lugs 79 on tank 2*b* which are supported directly on the undercarriage 9*b*. The engagement means also includes beams 74 which may be secured to the tank portion 2*b* or to the beam 73 and which are engageable from below by carrier arms 75 of a transport means which transports the whole assembly, including the hood and the tank, to a quenching plant. The carrier arms 75 are pivotable about pivots 80 of a traveling crab 76 of an inclined elevator 77 of the transport means in order to provide for the lifting of the coke tank 2*b*, along with the hood 5*b*, on a cable 78 and for the transporting of the assembly to an empty station. In this embodiment, the waiting time for the undercarriage is substantially reduced and a completely new unit, including both a hood portion and a tank portion, may be arranged alongside on the carriage in readiness.

While specific embodiments of the invention have been shown and described in detail to illustrate the application of the principles of the invention, it will be understood that the invention may be embodied otherwise without departing from such principles.

What is claimed is:

1. Apparatus for receiving incandescent coke from respective coke ovens of a horizontally arranged battery of coke ovens, comprising a wheeled carriage adapted to be moved backwardly and forwardly along the battery of coke ovens, a coke receiving device on said carriage including a closed hood portion adapted to be positioned into alignment with each of the ovens for the discharging of coke therefrom by the movement of said carriage and a tank portion below and enclosed by said hood, gas purifying means associated with said hood portion for removing impurities from the gases and discharging the purified gases, said coke hood portion having openable and closable lateral door means for receiving the incandescent coke from the oven and for closing the hood after receiving of the coke, said tank portion being located below said hood portion in a position to receive the coke discharged from the coke ovens through said hood portion, engagement means on said coke receiving device, and transport means movable along on said carriage and engageable with said engagement means to lift at least said tank portion off said carriage and to transport at least said tank away from said undercarriage.

2. Apparatus according to claim 1, wherein said engagement means is located on said tank and comprises an engagement lug, said transport means comprising a wheeled beam member engageable with said tank below said lugs for removing said tank laterally of said undercarriage.

3. Apparatus according to claim 2, wherein said hood portion includes a conical collar portion extending downwardly into said tank opening, support means on said undercarriage including a lifting surface having an upwardly sloping portion and a portion at a higher elevation, said wheeled beam being engageable on said lifting surfaces to move said tank upwardly into engagement with said collar and being removable from said surfaces to disengage said tank from said collar.

4. Apparatus according to claim 1, wherein said transport means includes a transport station having a cover thereon, roller means for moving said cover toward said undercarriage and over said tank portion, and means engageable with said tank portion to remove it from said hood portion and to move it in a direction of said cover means and to move said cover means with said tank portion away from said undercarriage.

5. Apparatus according to claim 1, wherein said transport means includes an inclined conveyor elevator, a crab movable upwardly and downwardly along said inclined elevator, a carrier arm on said crane engageable with said engagement means of said coke receiving device to lift said coke receiving device off said undercarriage.

6. Apparatus according to claim 1, wherein said hood portion and said tank portion are associated together in a unit, said engagement means including at least one lug on a side of said tank providing a support for said tank, and at least one beam extending outwardly from said coke receiving device, said transport means including a carrier arm engageable beneath said beam to lift said tank and said hood portion.

7. Apparatus according to claim 1, including at least two coke receiving devices on said undercarriage.

8. Apparatus according to claim 1, wherein there are at least two hood portions on said undercarriage.

9. Apparatus according to claim 1, wherein there are at least two tank portions on said undercarriage.

* * * * *